US008118383B2

(12) United States Patent
Mataki

(10) Patent No.: US 8,118,383 B2
(45) Date of Patent: Feb. 21, 2012

(54) PATTERN FORMING METHOD

(75) Inventor: Hiroshi Mataki, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 333 days.

(21) Appl. No.: 12/585,688

(22) Filed: Sep. 22, 2009

(65) Prior Publication Data

US 2010/0073413 A1 Mar. 25, 2010

(30) Foreign Application Priority Data

Sep. 24, 2008 (JP) ..... 2008-244234

(51) Int. Cl.
*B41J 29/38* (2006.01)

(52) U.S. Cl. ..... 347/9

(58) Field of Classification Search ..... 347/5, 9, 347/12

See application file for complete search history.

(56) References Cited

U.S. PATENT DOCUMENTS 6,810,814 B2 * 11/2004 Hasei ..... 101/485
7,138,304 B2 * 11/2006 Hirai ..... 438/149
2003/0030689 A1 2/2003 Hashimoto et al.

FOREIGN PATENT DOCUMENTS

JP 2003-080694 3/2003

* cited by examiner

*Primary Examiner* — An Do

(74) *Attorney, Agent, or Firm* — Jean C. Edwards, Esq.; Edwards Neils PLLC

(57) ABSTRACT

A pattern forming method includes the step of ejecting droplets of a liquid containing a functional component, from nozzles of an inkjet recording head onto a surface of a substrate in one direction in sequence so as to form a linear pattern on the surface of the substrate, wherein: the inkjet recording head is controlled in such a manner that $$p \le \frac{\pi d}{6\left(\frac{\theta}{\sin^2\theta} - \frac{\cos\theta}{\sin\theta}\right)\left\{\tan\frac{\theta}{2}\left(3 + \tan^2\frac{\theta}{2}\right)\right\}^{-\frac{2}{3}}}$$

is satisfied where d denotes a diameter of the droplets of the liquid before depositing on the surface of the substrate, θ denotes a contact angle of the droplets of the liquid with respect to the substrate, and p denotes a dot pitch of the droplets of the liquid that are adjacently deposited on the surface of the substrate, and the droplets of the liquid contain a volatile solvent with volume ratio not less than $$\left[1 - \frac{6p\left(\frac{\theta}{\sin^2\theta} - \frac{\cos\theta}{\sin\theta}\right)\left\{\tan\frac{\theta}{2}\left(3 + \tan^2\frac{\theta}{2}\right)\right\}^{-\frac{2}{3}}}{\pi d}\right] \times 100\%.$$

3 Claims, 8 Drawing Sheets

PATTERN FORMING METHOD

CROSS-REFERENCE TO RELATED APPLICATIONS

The present application claims priority from Japanese Patent Application No. 2008-244234, filed Sep. 24, 2008, the contents of which are herein incorporated by reference in their entirety.

BACKGROUND OF THE INVENTION

1. Field of the Invention

The present invention relates to a pattern forming method, and in particularly to a pattern forming method forming a linear pattern on a surface of a substrate with an ink jet head.

2. Description of the Related Art

Japanese Patent Application Publication No. 2003-80694 discloses a method for ejecting a liquid containing a functional component onto a substrate by means of inkjet so as to form a functional film pattern, wherein the liquid is ejected onto the substrate with a film forming surface having a contact angle falling within a range from 30 degrees to 60 degrees in such a manner that the liquid overlaps with a range of 1% or more and 10% or less of the diameter on the substrate, thereby forming conducting layer wiring.

When a liquid is ejected by means of inkjet so as to form a line on a substrate which the ejected liquid does not penetrate through (does not permeate), a bulge (a bunch) may be made in a portion of the line or jaggies may be made rather than a line having a smoothly linear (in the shape of a straight line) contour, depending on the interval or the amount of the liquid (liquid droplets) ejected on the substrate.

The method disclosed in Japanese Patent Application Publication No. 2003-80694 tries to avoid the braking or short-circuit of a conducting film wire. However, in cases of a pattern forming apparatus of an inkjet type, the dot pitch varies according to the accuracy of the landing positions (ejection direction and ejection volume) of ink ejected from an inkjet head and the accuracy of the position of a conveyed substrate. Therefore, it is difficult for the method disclosed in Japanese Patent Application Publication No. 2003-80694 to form lines with a uniform width in stable fashion.

SUMMARY OF THE INVENTION

It is an object of the present invention to provide a pattern forming method based on an inkjet system to form (make) a line-shape pattern with uniform width in a stable fashion.

In order to attain an object described above, one aspect of the present invention is directed to a pattern forming method comprising the step of ejecting droplets of a liquid containing a functional component, from nozzles of an inkjet recording head onto a surface of a substrate in one direction in sequence so as to form a linear pattern on the surface of the substrate, wherein: the inkjet recording head is controlled in such a manner that $$p \leq \frac{\pi d}{6\left(\frac{\theta}{\sin^2\theta} - \frac{\cos\theta}{\sin\theta}\right)\left\{\tan\frac{\theta}{2}\left(3 + \tan^2\frac{\theta}{2}\right)\right\}^{-\frac{2}{3}}}$$

is satisfied where d denotes a diameter of the droplets of the liquid before depositing on the surface of the substrate, θ denotes a contact angle of the droplets of the liquid with respect to the substrate, and p denotes a dot pitch of the droplets of the liquid that are adjacently deposited on the surface of the substrate, and the droplets of the liquid contain a volatile solvent with volume ratio not less than $$\left[1 - \frac{6p\left(\frac{\theta}{\sin^2\theta} - \frac{\cos\theta}{\sin\theta}\right)\left\{\tan\frac{\theta}{2}\left(3 + \tan^2\frac{\theta}{2}\right)\right\}^{-\frac{2}{3}}}{\pi d}\right] \times 100\%.$$

Desirably, time interval from ejection of one of the droplets of the liquid that are to be adjacently deposited on the surface of the substrate until ejection of another one of the droplets of the liquid that are to be adjacently deposited on the surface of the substrate, is set to be 1 millisecond or less.

Desirably, the pattern forming method further comprises the step of ejecting droplets of the liquid from the nozzles onto a preliminary area other than the substrate, preliminary to ejection of the droplets of the liquid onto the surface of the substrate from the nozzles, wherein the ejection of the droplets of the liquid onto the surface of the substrate to form the linear pattern is started within one second after ejection of the droplets of the liquid onto the preliminary area.

According to the present invention, the dot pitch and the volume ration of a volatile solvent of a liquid are controlled in accordance with the above formulas, and thereby occurrence of jaggies or bulges can be prevented.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Desirable embodiments of a pattern forming method according to embodiments of the present invention are described below with reference to drawings.

Configuration of Pattern Forming Device

Figure 1:
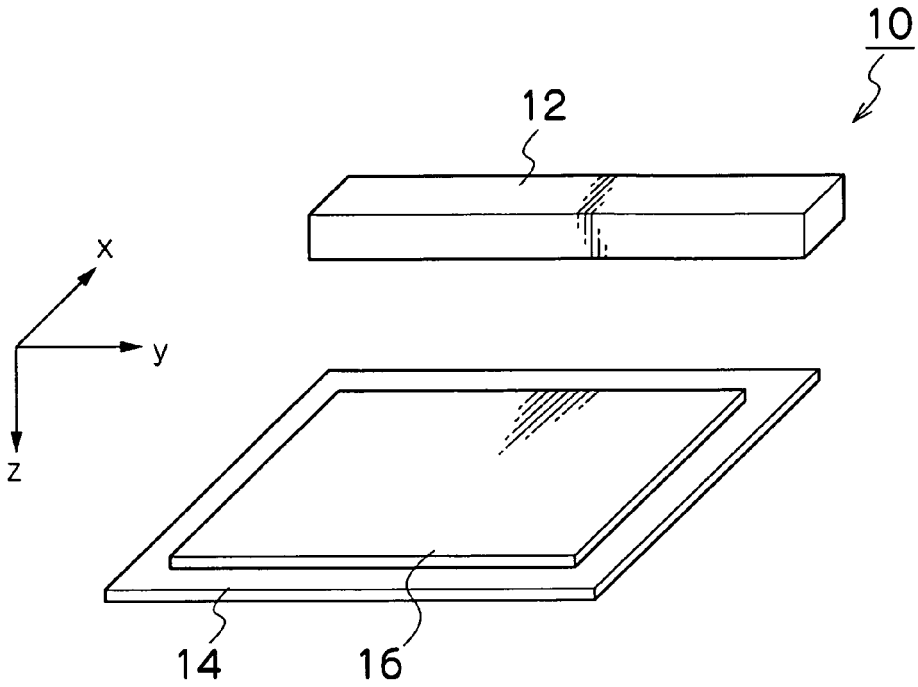
FIG. 1 is an oblique perspective view illustrating a pattern forming device related to a first embodiment of the present invention.

FIG. 1 is an oblique perspective view illustrating a pattern forming device related to a first embodiment of the present invention.

As illustrated in FIG. 1, the pattern forming device (ink jet recording device) 10 of the present embodiment includes an ink jet head (referred to hereinbelow as "recording head") 12 and a support plate 14.

The recording head 12 is a line-type of recording head in which a plurality of nozzles 22 are aligned in the main scanning direction (y direction in FIG. 1).

A substrate 16 that is an object onto which a liquid is ejected from the recording head 12, is placed on the support plate 14. The support plate 14 is supported so as to maintain a constant clearance gap with the recording head 12, and is capable of scanning (moving) in the sub-scanning direction (x direction in FIG. 1).

By causing the recording head 12 to eject liquid droplets while causing the support plate 14 to move in the x direction, the liquid can be deposited on the entire surface of the imaging region of the substrate 16.

Figure 2:
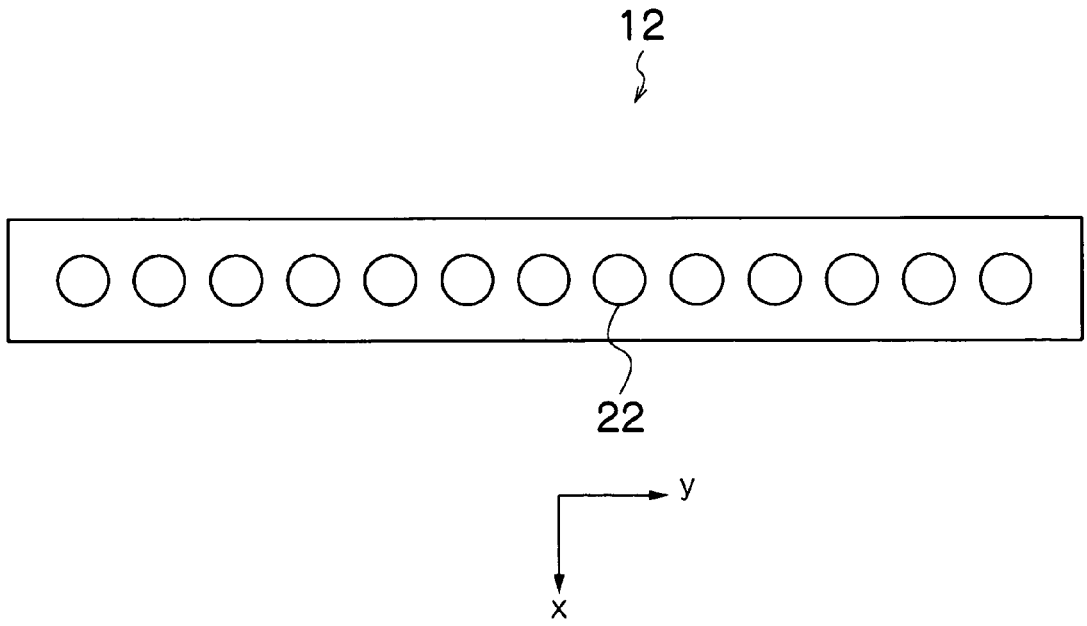
FIG. 2 is a plan view illustrating a surface in which nozzles of a recording head are formed.

FIG. 2 is a plan view illustrating a surface where the nozzles of the recording head 12 are formed.

As illustrated in FIG. 2, the recording head 12 has a structure in which ejection elements 20 (see FIG. 3), each having a nozzle 22 and a pressure chamber 24, are arranged substantially equidistantly in the main scanning direction (y direction) substantially perpendicular to the sub-scanning direction (x direction).

A nozzle diameter of the recording head 12 is, for example, 35 μm and the distance between the centers of adjacent liquid droplets on the substrate 16 (nozzle pitch) is, for example, 254 μm (100 npi (nozzles per inch)). The recording head 12 has a jet-out period (ejection cycle) of 1 kHz, and droplets can be continuously jetted out at a head scanning (moving) rate of 0.1 msec.

Figure 3:
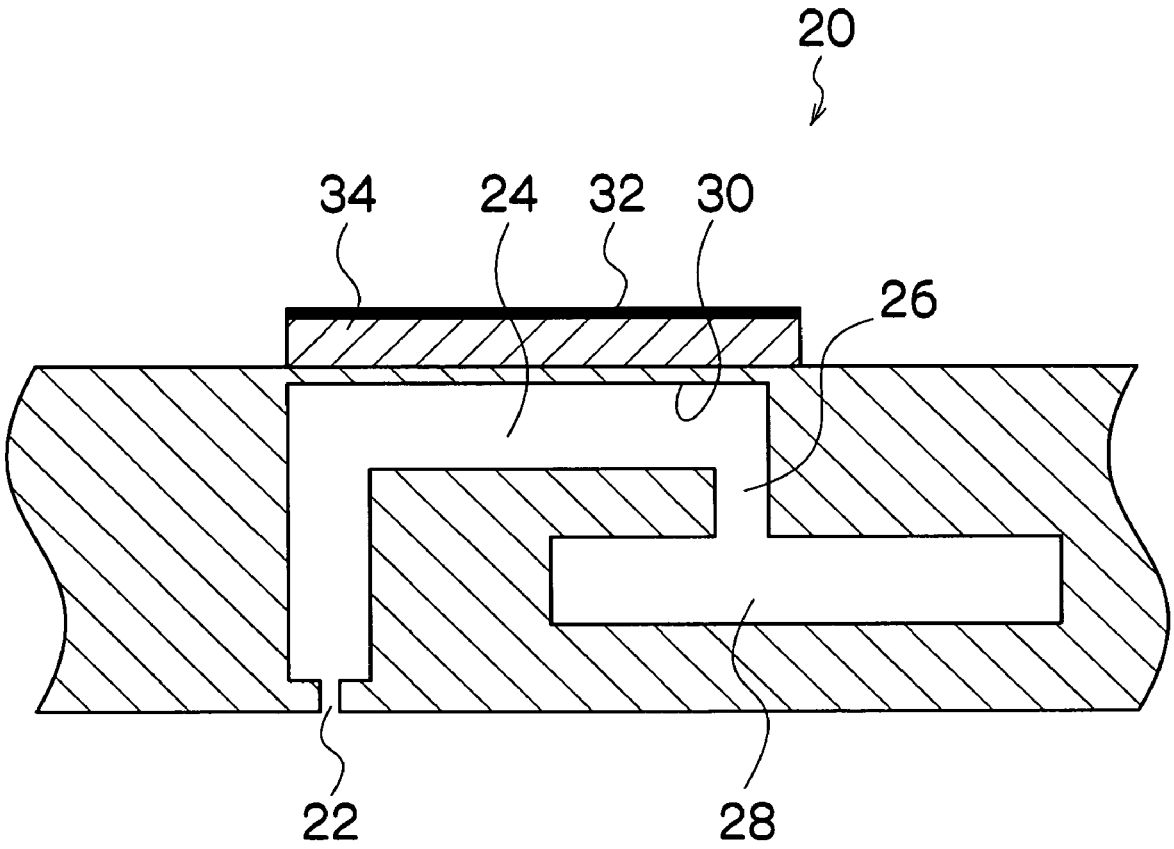
FIG. 3 is a cross-sectional diagram illustrating an ejection element.

FIG. 3 is a cross-sectional diagram illustrating an ejection element 20.

The pressure chambers 24 provided correspondingly to the nozzles 22 have a substantially square shape in a plan view thereof. An outflow port leading to the corresponding nozzle 22 is provided in one inner corner on a diagonal line of each pressure chamber 24, and a liquid supply port 26 leading to the corresponding pressure chamber 24 is provided in the other corner. In addition to the aforementioned square shape, the pressure chambers 24 can have a polygonal shape such as tetragonal shape (rhomboidal shape, rectangular shape), pentagonal shape, or hexagonal shape, and also round shape or elliptical shape.

As illustrated in FIG. 3, the pressure chambers 24 of the ejection elements 20 are linked to a common channel 28 via the supply ports 26. The common channel 28 is linked to a tank (not illustrated in the figure) that serves as a liquid supply source, and the liquid supplied from the tank is distributed and supplied to the pressure chambers 24 via the common channel 28.

Piezoelectric elements 34 provided with individual electrodes 32 respectively are bonded to a pressure plate (oscillation plate (diaphragm) also serving as a common electrode) 30 constituting parts of the surfaces (top surface in FIG. 3) of the pressure chambers 24. For example, a piezoelectric material such as lead zirconium titanate (PZT) or barium titanate can be used as a material for the piezoelectric elements 34.

Where a drive signal is applied between an individual electrode 32 and the common electrode, the corresponding piezoelectric element 34 is deformed and the volume of the corresponding pressure chamber 24 changes. As a result, the pressure inside the pressure chamber 24 changes, thereby ejecting a droplet from the corresponding nozzle 22. After the droplet has been ejected, the displacement of the piezoelectric element 34 returns to the original state, and the pressure chamber 24 is refilled with new liquid from the common channel 28 via the supply port 26.

In the present embodiment, a system is employed by which ink is pressurized by deformation of the piezoelectric elements 34, but actuators of other systems (for example, a thermal system) may be also employed.

Figure 4:
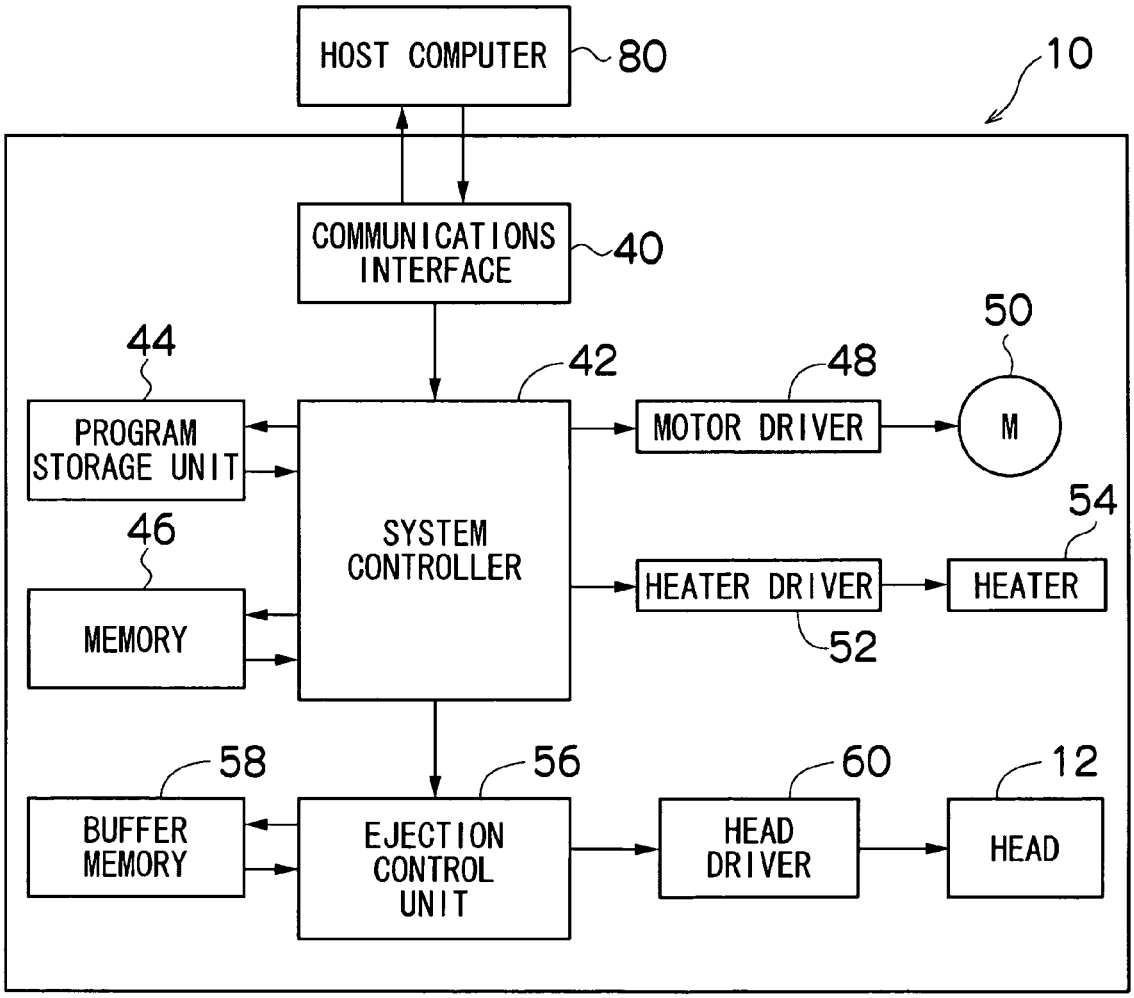
FIG. 4 is a block diagram illustrating a control system of a pattern forming apparatus.

FIG. 4 illustrates a block diagram illustrating a control system of the pattern forming device 10.

The pattern forming device 10 includes a communications interface 40, a system controller 42, a memory 46, a motor driver 48, a heater driver 52, an ejection control unit 56, a buffer memory 58 and a head driver 60.

The communications interface 40 functions as an interface unit receiving ejection date sent from a host computer 80. As the communications interface 40, USB (Universal Serial Bus), IEEE1394, Ethernet (registered trademark), wireless network, other serial networks, parallel interface such as Centronics may be used. Further, a buffer memory may be mounted on this portion in order to speed up the communications.

The system controller 42 includes a CPU (central processing unit) and the peripheral circuits, and functions as a control unit controlling each section of the pattern forming device 10. This system controller 42 controls the communications with the host computer 80, controls read-in and writing-in the memory 46, generates control signals to control the motors 50 of the conveyance drive system and the heater 54, and performs other control.

Control programs of the pattern forming device 10 are stored in a program storage unit 44. The system controller 42 reads out various sorts of control programs stored in the program storage unit 44 and performs the read-out programs in a proper manner.

The memory 46 is a memory device used as a temporary storage area of date and a working area when the system controller 42 carries out various sorts of calculations. As the memory 46, a memory formed from a semiconductor element, or a magnetic medium such as a hard disk may be used.

The motor 50 drives a driving system for driving at least one of the recording head 12 and the support plate 14 in FIG. 1 so as to cause the recording head 12 and the support plate 14 to move relatively. The motor driver 48 drives the motor in accordance with control commands from the system controller 42.

The heater driver 52 drives the heater 54 in accordance with control signals from the system controller 42. The heater 54 includes heaters for adjusting temperature provided on parts of the pattern forming device 10.

The ejection date sent from the host computer 80 is sent into the pattern forming device 10 via the communications interface 40, and is temporarily stored in the memory 46.

The ejection control unit 56 has a signal processing function to carry out various processing and correction to generate signals for controlling the ejection from the ejection data stored in the memory 46 in accordance with the control by the system controller 42, and supplies the generated print control signals (dot data) to the head driver 60. Required signal processing is carried out in the ejection control unit 56, and the ejection amount and the ejection timing of the liquid from the head 12 are controlled via the head driver 60, on the basis of the ejection data.

The head driver 60 drives the piezoelectric elements 34 of the recording head 12 on the basis of the ejection data supplied from the ejection control unit 56. The head driver 60 may include a feedback control system to keep constant drive conditions of the head.

The ejection control unit 56 is provided with a buffer memory 58; and ejection data, parameters, and other data are temporarily stored in the buffer memory 58 when the ejection data is processed in the ejection control unit 56.

It is possible to use the buffer memory 58 as the memory 46. It is also possible to integrate the ejection control unit 56 and the system controller 42 in such a manner that both the ejection control unit 56 and the system controller 42 are realized by one processor.

Although not illustrated in the drawings, the pattern forming apparatus 10 comprises a supply system for supplying liquid to the recording head 12 and a maintenance unit which carries out maintenance of the recording head 12.

Liquid Ejection Conditions

Figure 5:
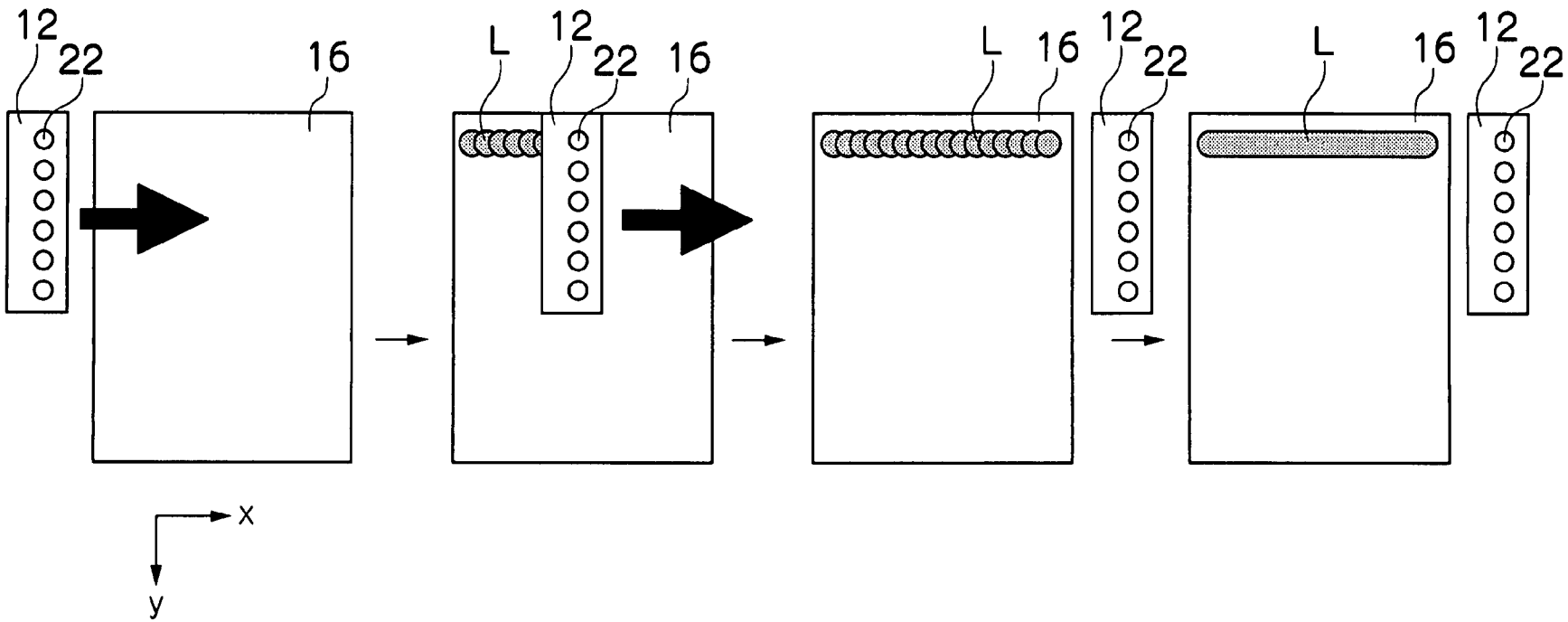
FIG. 5 is a diagram illustrating steps of a scanning control for making a pattern L by causing the recording head and a substrate to move relatively in an x direction.

FIG. 5 is a diagram illustrating a schematic view of a scanning control procedure when recording a pattern L by scanning (moving) the recording head 12 and the substrate 16 relatively in the x direction.

As illustrated in FIG. 5, in the present embodiment, a linear (for example, a straight line) pattern L is described by ejecting a liquid (ink) formed by mixing a functional component (for example, silver nano-particles) in a volatile solvent (for example, water or tetradecane) while scanning (moving) the recording head 12 and the substrate 16 relatively in the x direction. In this case, if the interval (dot pitch p) between the liquid droplets D ejected onto the substrate 16 is large, then jaggies become liable to occur. Furthermore, if the ratio of the volatile solvent contained in the liquid is large, then bulges become liable to occur. Below, the conditions with respect to the dot pitch p and the ratio of solvent in the liquid in order to prevent the occurrence of jaggies and bulges are determined.

Liquid Ejection Condition 1 (Dot Pitch p)

Figure 6A:
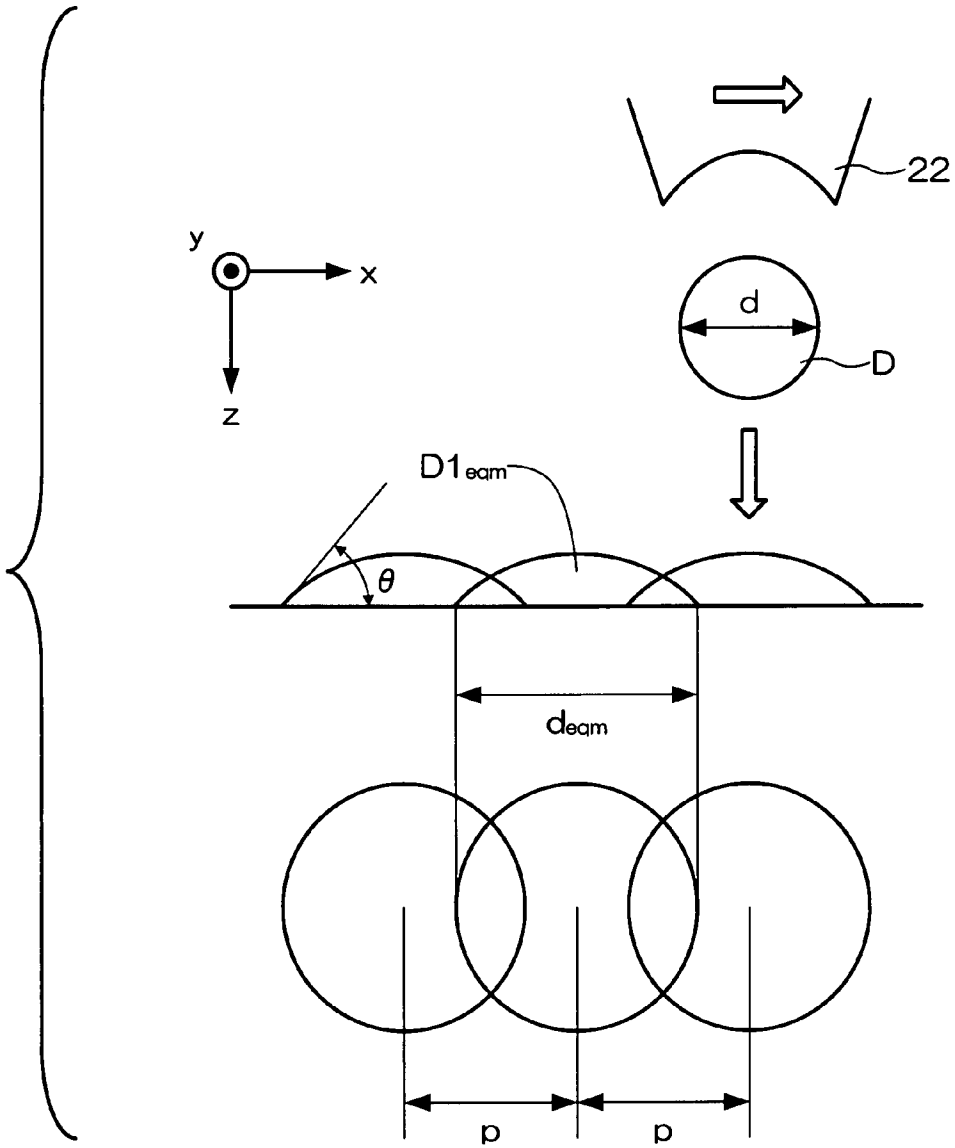
FIGS. 6A and 6B are views (including cross-sectional diagrams and plan views) illustrating the changing state over time of liquid droplets ejected onto the surface of the substrate.
Figure 6B:
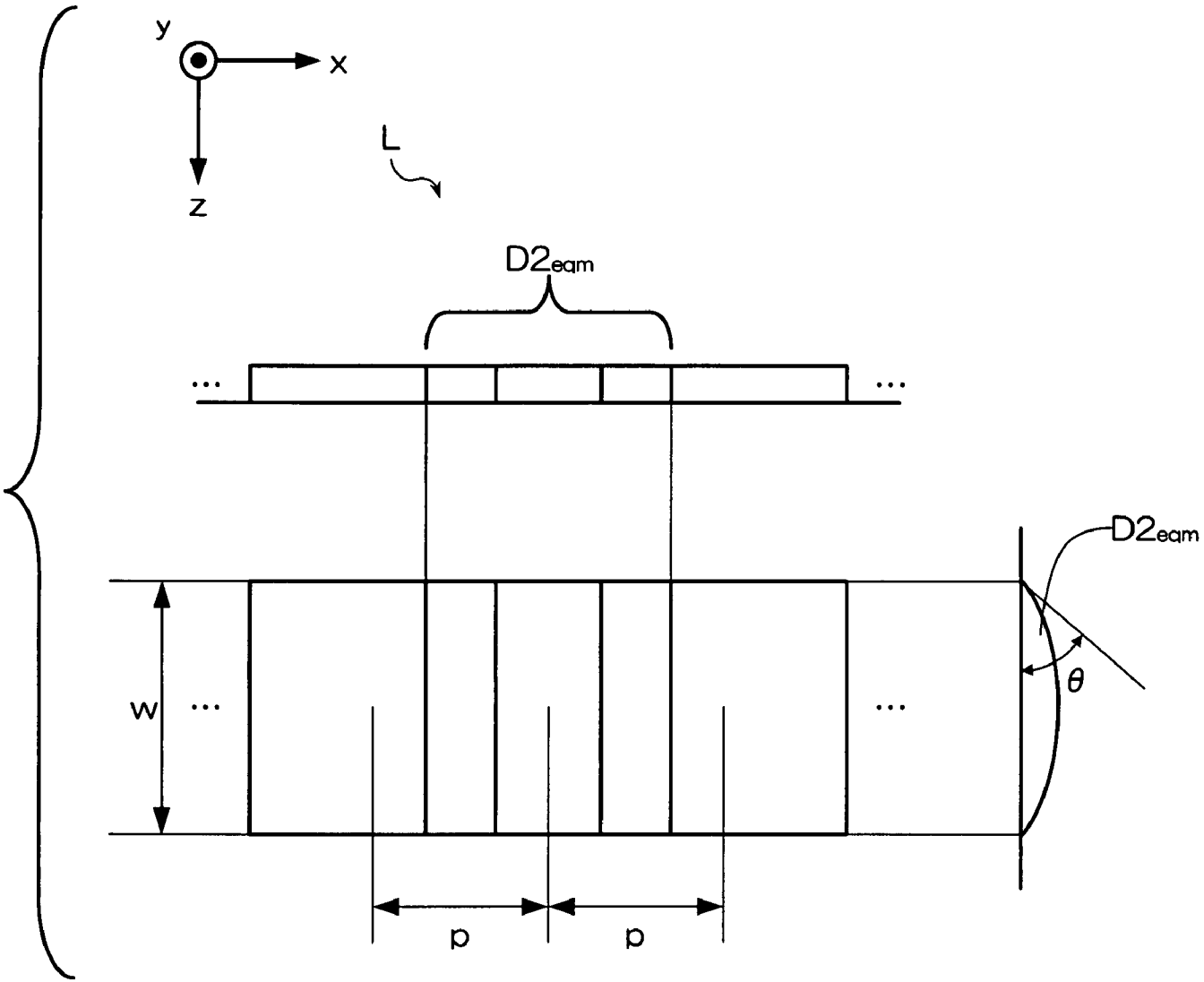

FIGS. 6A and 6B are a diagram illustrating a schematic and plan view of temporal change in liquid droplets ejected onto the surface of a substrate 16.

As illustrated in FIG. 6A, droplets $D1_{eqm}$ which have been ejected from the recording head 12 and have landed on the surface of the substrate 16 have a substantially round shape at the start of landing and makes contact with an adjacent droplet. As illustrated in FIG. 6B, each of the droplets D wets and spreads to form a pattern L.

Here, it is supposed that the substrate 16 is a medium into which the droplets D do not penetrate (permeate), and the volume of the droplets is the same before and after landing on the substrate 16. Furthermore, it is supposed that the angle of contact θ (rad) of the droplet D with respect to the substrate 16 is uniform.

In this case, the ratio $\beta_{eqm}$ between the diameter $d_{eqm}$ (μm) of a droplet $D1_{eqm}$ after landing on the substrate 16 and the diameter d (μm) of the droplet D before landing (the rate of spreading) is expressed by Formula (1) below. Here, the diameter d is the diameter when the droplet D before landing is converted to a sphere.

$$\beta_{eqm} = \frac{d_{eqm}}{d} = 2\left\{\left(\tan\frac{\theta}{2}\right)\left(3+\tan^2\frac{\theta}{2}\right)\right\}^{-\frac{1}{3}} \quad \text{Formula (1)}$$

If the width of the pattern L is taken as w (μm), then the cross-sectional surface area S1 ($\mu m^2$) of the droplet $D2_{eqm}$ in FIG. 6B in a section taken in a plane parallel to the zy plane passing through the center of the droplet $D2_{eqm}$ is expressed by Formula (2) below.

$$S1 = \frac{1}{4}w^2\left(\frac{\theta}{\sin^2\theta} - \frac{\cos\theta}{\sin\theta}\right) \quad \text{Formula (2)}$$

Therefore, if the distance (nozzle pitch) between the centers of adjacently positioned droplets on the substrate 16 is taken as p (μm), then the volume Va ($\mu m^3$) of the droplet $D2_{eqm}$ is expressed by Formula (3) below.

$$Va = \frac{1}{4}w^2 p\left(\frac{\theta}{\sin^2\theta} - \frac{\cos\theta}{\sin\theta}\right) \quad \text{Formula (3)}$$

On the other hand, since the diameter of the droplet before landing is d, then the volume Vb ($\mu m^3$) of the droplet D before landing is expressed by Formula (4) below.

$$Vb = \frac{1}{6}\pi d^3 \quad \text{Formula (4)}$$

From Formula 1 above, the volume of the droplet D remains unchanged, before and after landing. If Va=Vb is solved with respect to the width w, then Formula (5) below is obtained.

$$w = \sqrt{\frac{2\pi d^3}{3p\left(\frac{\theta}{\sin^2\theta} - \frac{\cos\theta}{\sin\theta}\right)}} \quad \text{Formula (5)}$$

Here, since $w \geqq d_{eqm} = \beta_{eqm} d$, then if Formula (5) is solved by taking the dot pitch p as a variable, the conditional Formula (6) for the dot pitch p is obtained.

$$p \leq \frac{2\pi d}{3\beta_{eqm}^2\left(\frac{\theta}{\sin^2\theta} - \frac{\cos\theta}{\sin\theta}\right)} = \frac{\pi d}{6\left(\frac{\theta}{\sin^2\theta} - \frac{\cos\theta}{\sin\theta}\right)\left\{\tan\frac{\theta}{2}\left(3+\tan^2\frac{\theta}{2}\right)\right\}^{-\frac{2}{3}}} \quad \text{Formula (6)}$$

By controlling the dot pitch p so as to satisfy the condition in Formula (6) above, it is possible to prevent the occurrence of raggedness (jaggies) in the outline of the pattern L.

Liquid Ejection Condition 2 (Condition Relating to Ratio of Solvent (Volatile Component) in Liquid)

Next, the condition relating to the ratio of the solvent (volatile component) in the liquid will be described. Here, the liquid ejected onto the substrate 16 is taken to be, for example, a liquid (ink) obtained by dispersing silver nano-particles in a solvent of water or tetradecane (both of which have volatile properties).

As described above, when a pattern L is described by ejecting liquid onto the substrate 16, if the amount of solvent (liquid component) in the pattern L is too great with respect to the line width w, then bulges are liable to occur. In order to prevent the occurrence of bulges, the amount of solvent on the substrate 16 should be reduced to a level whereby bulges do not occur when the solvent is evaporated off after the droplet D has landed on the substrate 16. More specifically, the amount of solvent is set in such a manner that the diameter $d_{eqm}$ (μm) of the droplet D after wetting and spreading on the substrate 16 and after the solvent has evaporated off is equal to the line width w (μm). If $w=d_{eqm}$, then the volume $V_1$ ($\mu m^3$) of the droplet D2$_{eqm}$ after wetting and spreading and evaporation of the solvent is represented by Formula (7) below.

$$V_1 = p\left\{\theta\left(\frac{d_{eqm}}{2\sin\theta}\right)^2 - \frac{d_{eqm}^2\cos\theta}{4\sin\theta}\right\} \quad \text{Formula (7)}$$

On the other hand, since the diameter of the droplet before landing is d, then the volume $V_2$ ($\mu m^3$) of the droplet D before landing is expressed by Formula (8) below.

$$V_2 = \frac{4}{3}\pi\left(\frac{d}{2}\right)^3 \quad \text{Formula (8)}$$

Consequently, the ratio of the volatile solvent contained in the liquid (volume ratio) $\{(V_2-V_1)/V_2\times100(\%)\}$ is expressed by Formula (9) below.

$$\frac{V_2 - V_1}{V_2}\times100\% = \left[1 - \frac{p\left\{\theta\left(\frac{d_{eqm}}{2\sin\theta}\right)^2 - \frac{d_{eqm}^2\cos\theta}{4\sin\theta}\right\}}{\frac{4}{3}\pi\left(\frac{d}{2}\right)^3}\right]\times100\% \quad \text{Formula (9)}$$

$$= \left[1 - \frac{6p\left(\frac{\theta}{\sin^2\theta} - \frac{\cos\theta}{\sin\theta}\right)\left\{\tan\frac{\theta}{2}\left(3+\tan^2\frac{\theta}{2}\right)\right\}^{-\frac{2}{3}}}{\pi d}\right]\times100\%$$

By setting the ratio of the volume of volatile solvent in the liquid to a value equal to or greater than that expressed by Formula (9) above, it is possible to prevent the occurrence of bulging.

Liquid Ejection Condition 3 (Interval Between Droplet Ejection Timings)

Next, the interval between droplet ejection timings will be described. Table 1 indicates the stability of the line width w when lines were recorded at different values of the number of droplets D ejected per second (i.e. printing frequency), and different dot pitches, taking droplet diameter as d=26.0 (μm), $d_{eqm}$=55.5 (μm) and the angle of contact as θ=30(°) (in other words, under conditions which satisfy Formulas (6) and (9) above).

TABLE 1

| Printing Frequency | Dot Pitch [μm] | | | |
|---|---|---|---|---|
| [Hz] | 20 | 30 | 40 | 50 |
| 10 | Poor | Poor | Poor | Poor |
| 1000 | Good | Good | Average | Poor |
| 10000 | Good | Good | Good | Poor |

In Table 1, a case where the line width w of the printed line is stable (for example, a case where the amount of variation in the line width w (for example, the difference between the maximum value and minimum value of the line width w per unit length) is less than a prescribed value) is indicated as "Good", a case where the amount of variation in the line width w is equal to or greater than the prescribed value but the amount of variation is not as large as a "Poor" case is indicated as "Average", and a case where the amount of variation in the line width w is greater than the maximum value of the amount of variation in an "Average" case is indicated as "Poor". According to the experimental results in Table 1, if the printing frequency was equal to or greater than 1000 Hz, then the line width w was stable and results which are free of the occurrence of bulges and jaggies were obtained.

Consequently, the interval from printing the $n^{th}$ droplet until printing the $(n+1)^{th}$ droplet is set to be 1 millisecond or less. By adopting such an interval, it is possible to prevent the combination on the substrate 16 during printing of portions which are in a balanced state (a state where the droplets D have wet and spread and the shape of the droplets D is stable) and portions which are in an unbalanced state (a state during the wetting and spreading of the droplets D and before the shape of the droplets D has become stable). Consequently, a balanced state is achieved and it becomes possible to obtain recorded lines of uniform width, without the formation of large pools of droplets D in an unbalanced state or thickening of a portion of the pattern L.

Liquid Ejection Condition 4 (Preliminary Ejection)

Next, preliminary ejection before the start of printing will be described.

In a pattern forming apparatus of an inkjet type, if a state where ink is not ejected has continued for a prescribed period of time or longer, the solvent in the ink adhering to the vicinity of the nozzles 22 of the recording head 12 evaporates off, the density of the silver nano-particles of the ink becomes higher and the viscosity becomes higher. If this occurs, then when a piezoelectric element 34 (see FIG. 3) is operated, a liquid ejection error or ejection failure occurs.

Consequently, in the present embodiment, ink of high viscosity which is adhering to the vicinity of the nozzles 22 is removed by carrying out preliminary ejection ("dummy ejection", "purging", "spit ejection") in order to eject ink onto a prescribed preliminary ejection region before the start of printing. Furthermore, by carrying out preliminary ejection also after the soiling on the nozzle surface has been wiped by a wiper (not illustrated) of a cleaning blade which is provided as a nozzle surface wiping device, infiltration of foreign matter into the nozzles due to the wiping operation of the wiper is prevented.

If the preliminary ejection described above is carried out, desirably, printing is started within one second after preliminary ejection. By this means, it is possible to print lines of a stable uniform width.

Carrying out preliminary ejection onto the substrate 16 may possibly cause problems in the product, and therefore it is desirable to provide a preliminary ejection region in the pattern forming apparatus 10. In order to shorten the time period from the carrying out of preliminary ejection until the start of printing, it is desirable that the preliminary ejection region should be located in the whole of the periphery of the substrate 16 or the print start position ST.

Figure 7:
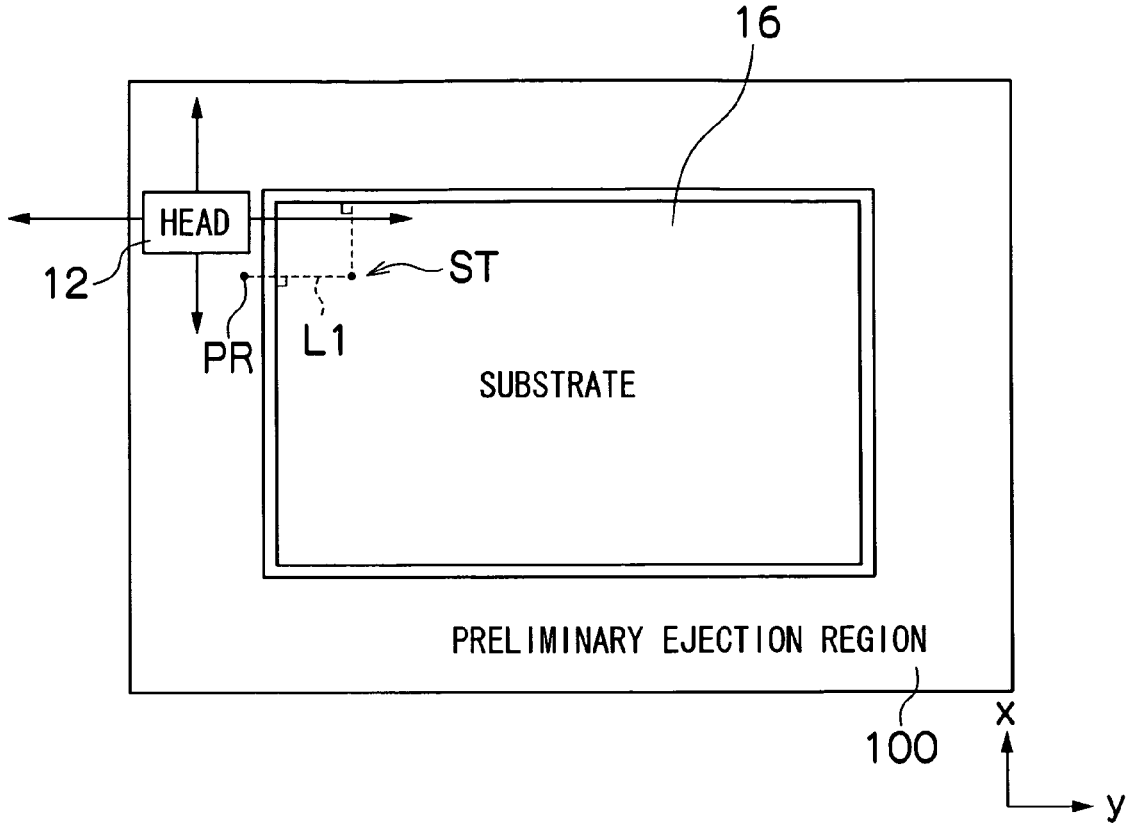
FIG. 7 is a plan view illustrating a positional example of a preliminary ejection region.
Figure 8:
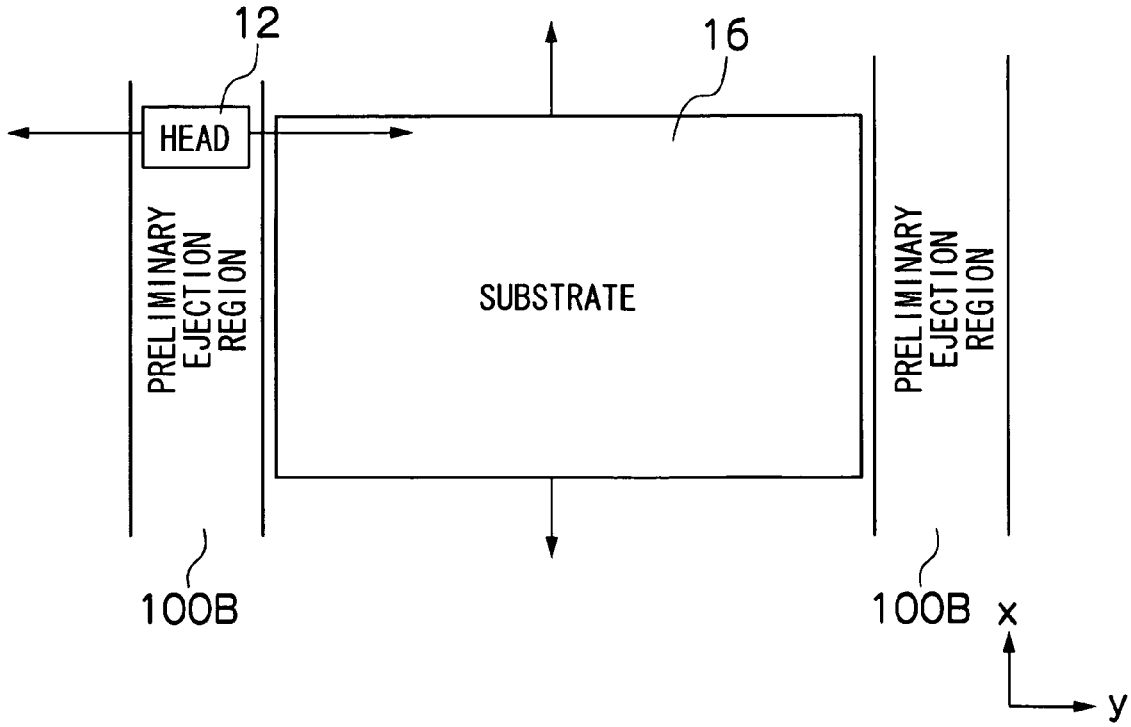
FIG. 8 is a plan view illustrating another positional example of the preliminary ejection region.
Figure 9:
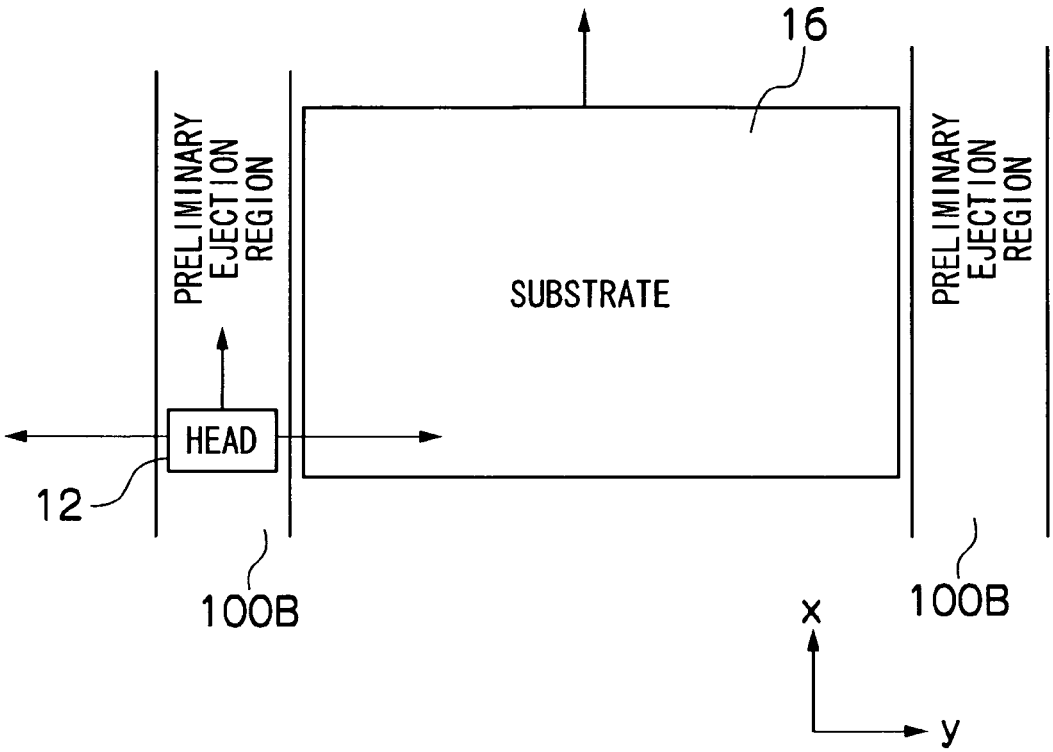
FIG. 9 is a plan view illustrating another positional example of the preliminary ejection region.

FIG. 7 to FIG. 9 are plan diagrams illustrating examples of the positioning of the preliminary ejection region.

In the example illustrated in FIG. 7, the recording head 12 is movable in the xy directions and a preliminary ejection region 100 is provided in a region surrounding the substrate 16 on the substrate 16 mounting surface of a support plate 14.

When preliminary ejection is carried out, the perpendicular line L1 of shortest length of lines connecting to the inner circumference of the preliminary ejection region 100 from the print start position (point) ST of the substrate 16 is selected. Preliminary ejection is carried out at a point (preliminary ejection position) PR on the line obtained by extending the vertical pattern L1 toward the preliminary ejection region 100 side. The preliminary ejection position PR is set at a position where the distance between the preliminary ejection position PR and the substrate 16 is longer than the predicted radius of the droplet when the liquid ejected by preliminary ejection has landed on the preliminary ejection region 100. Thereupon, after the end of preliminary ejection, the recording head 12 is moved to the printing start position ST following the perpendicular pattern L1. By this means, it is possible to shorten the time from the end of preliminary ejection until the start of printing at the printing start position ST.

In the examples illustrated in FIG. 8 and FIG. 9, a preliminary ejection region 100A is provided on either side of the substrate 16. In the example illustrated in FIG. 8, the recording head 12 is movable in the ±y direction and the substrate 16 is movable in the ±x direction. Furthermore, in the example illustrated in FIG. 9, the recording head 12 is movable in the xy directions and the substrate 16 is movable in the +x direction.

In the examples illustrated in FIG. 8 and FIG. 9, by setting the preliminary ejection similarly to FIG. 7, it is possible to shorten the time period from the end of preliminary ejection until the start of printing at the printing start position ST.

It has been confirmed that the phenomenon of large swelling of a portion of the line occurs over a time scale of 2 to 8 seconds. Therefore, by controlling the heater 54, or the like, to solidify the droplets D on the substrate 16 within one second after landing, it is also possible to prevent the occurrence of bulges.

Pattern Forming Procedure

Figure 10:
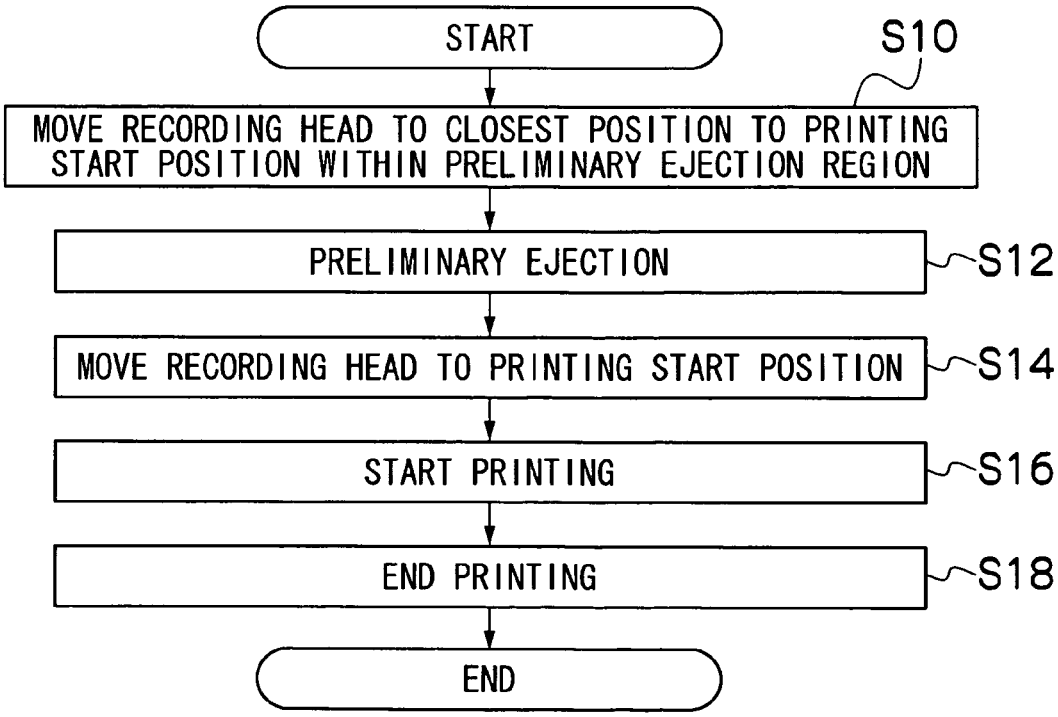
FIG. 10 is a flowchart indicating steps for a pattern forming.

Next, steps for pattern forming are described by referring to the flowchart in FIG. 10.

Firstly, the system controller 42 obtains the co-ordinates of the printing start position ST on the substrate 16 and calculates the co-ordinates of the point where preliminary ejection is possible which is closest to the printing start position ST in the preliminary ejection region 100 (the preliminary ejection position PR). The system controller 42 outputs a control signal to the head driver 60, thereby moving the recording head 12 to the preliminary ejection position PR (step S10).

Next, preliminary ejection is carried out (step S12), the recording head 12 is moved to the printing start position ST (step S14) and printing is started (step S16). Thereupon, printing of a pattern L is carried out using a dot pitch which satisfies the condition in Formula (6) above and at a droplet ejection interval of 1 millisecond or less (step S18).

Here, the system controller 42 controls the recording head 12 and the support plate 14 in such a manner that the processes from step S12 to step S16 are completed within one second.

According to the present embodiment, it is possible to prevent the occurrence of jaggies and bulges by controlling the dot pitch p so as to satisfy the condition in Formula (6) above, by setting the ratio of the volume of volatile solvent in the liquid to a value equal to or greater than that expressed by Formula (9) above, and by setting the droplet ejection time interval and the time interval from preliminary ejection to a prescribed value or less.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A pattern forming method comprising the step of ejecting droplets of a liquid containing a functional component, from nozzles of an inkjet recording head onto a surface of a substrate in one direction in sequence so as to form a linear pattern on the surface of the substrate, wherein:

the inkjet recording head is controlled in such a manner that $$p \le \frac{\pi d}{6\left(\frac{\theta}{\sin^2\theta} - \frac{\cos\theta}{\sin\theta}\right)\left\{\tan\frac{\theta}{2}\left(3 + \tan^2\frac{\theta}{2}\right)\right\}^{-\frac{2}{3}}}$$

is satisfied where d denotes a diameter of the droplets of the liquid before depositing on the surface of the substrate, θ denotes a contact angle of the droplets of the liquid with respect to the substrate, and p denotes a dot pitch of the droplets of the liquid that are adjacently deposited on the surface of the substrate, and the droplets of the liquid contain a volatile solvent with volume ratio not less than $$\left[1 - \frac{6p\left(\frac{\theta}{\sin^2\theta} - \frac{\cos\theta}{\sin\theta}\right)\left\{\tan\frac{\theta}{2}\left(3 + \tan^2\frac{\theta}{2}\right)\right\}^{-\frac{2}{3}}}{\pi d}\right] \times 100\%.$$

2. The pattern forming method as defined in claim 1, wherein time interval from ejection of one of the droplets of the liquid that are to be adjacently deposited on the surface of the substrate until ejection of another one of the droplets of the liquid that are to be adjacently deposited on the surface of the substrate, is set to be 1 millisecond or less.

3. The pattern forming method as defined in claim 1, further comprising the step of ejecting droplets of the liquid from the nozzles onto a preliminary area other than the substrate, preliminary to ejection of the droplets of the liquid onto the surface of the substrate from the nozzles, wherein the ejection of the droplets of the liquid onto the surface of the substrate to form the linear pattern is started within one second after ejection of the droplets of the liquid onto the preliminary area.

* * * * *